United States Patent [19]

Halpern

[11] Patent Number: 4,989,861

[45] Date of Patent: Feb. 5, 1991

[54] PULSE FORCE GENERATING AND LOADING EXERCISE DEVICE AND METHOD

[76] Inventor: Alan A. Halpern, 1400 Low Rd., Kalamazoo, Mich. 49008

[21] Appl. No.: 465,447

[22] Filed: Jan. 16, 1990

Related U.S. Application Data

[63] Continuation of Ser. No. 256,602, Oct. 12, 1988, abandoned.

[51] Int. Cl.[5] ..... A63B 21/005

[52] U.S. Cl. ..... 272/129; 272/117; 272/134; 128/25 R

[58] Field of Search ..... 272/99, 117, 118, 129, 272/130, 134; 128/24 R, 24.2, 24.5, 25 R, 36, 38, 44

[56] References Cited

U.S. PATENT DOCUMENTS

| | | | |
|---|---|---|---|
| 2,626,601 | 1/1953 | Riley | 128/38 |
| 4,390,179 | 6/1983 | Szkalak | 272/118 |
| 4,544,154 | 10/1985 | Ariel | 272/129 |
| 4,628,910 | 12/1986 | Krukowski | 272/129 X |
| 4,654,009 | 3/1987 | Greene | 128/25 R X |
| 4,711,450 | 12/1987 | McArthur | 272/129 |
| 4,726,582 | 2/1988 | Fulks | 272/129 |
| 4,741,530 | 5/1988 | Wolf | 272/134 |
| 4,750,738 | 6/1988 | Dang | 272/129 X |
| 4,822,036 | 4/1989 | Dang | 272/129 |
| 4,822,037 | 4/1989 | Makansi et al. | 272/129 |

*Primary Examiner*—Robert Bahr

*Attorney, Agent, or Firm*—Gordon W. Hueschen

[57] ABSTRACT

An exercise device is provided together with a method for using the device which, when used either independently or in combination with a conventional exercise apparatus, generates a series of pulse forces in the same direction as the resistance force applied by the conventional apparatus in combination with which the present device is utilized, and in a direction opposite to that applied by the subject utilizing the exercise device, and with force sufficient to move the body member of the subject a short distance and thereby to stretch the muscles of the body member with each pulse force. The stretching of the muscles by the application of the pulse forces results over a period of time in the strengthening of the body member muscles to a greater degree than would occur as a result of exercising with the conventional apparatus alone.

35 Claims, 7 Drawing Sheets

Fig. 1.
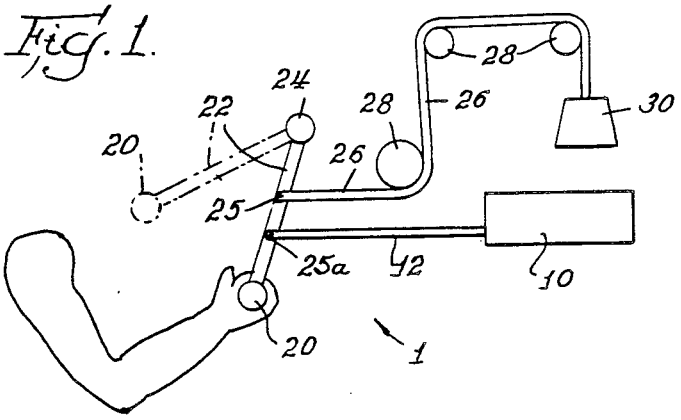
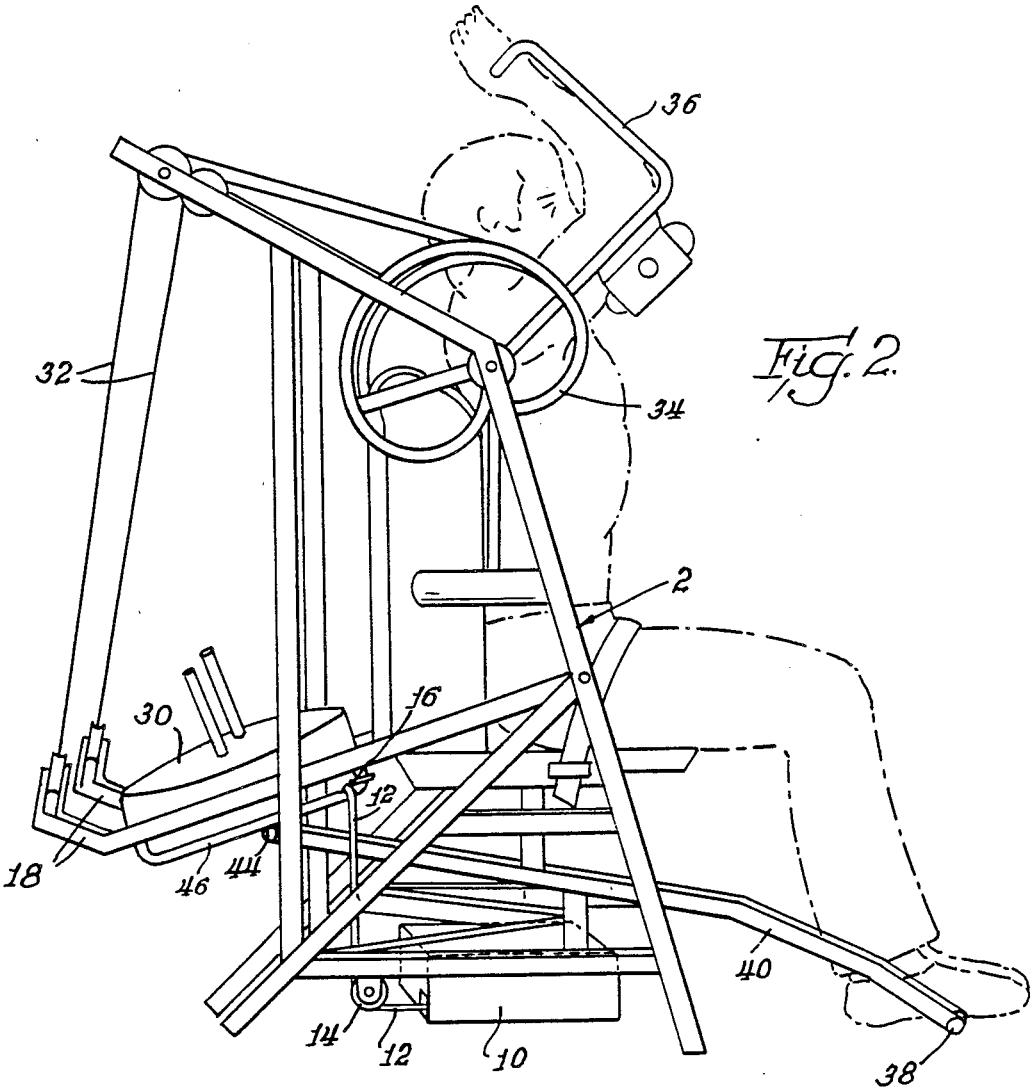
Fig. 2.

30
5
27
10
17
23
12
21
19
19
27
21

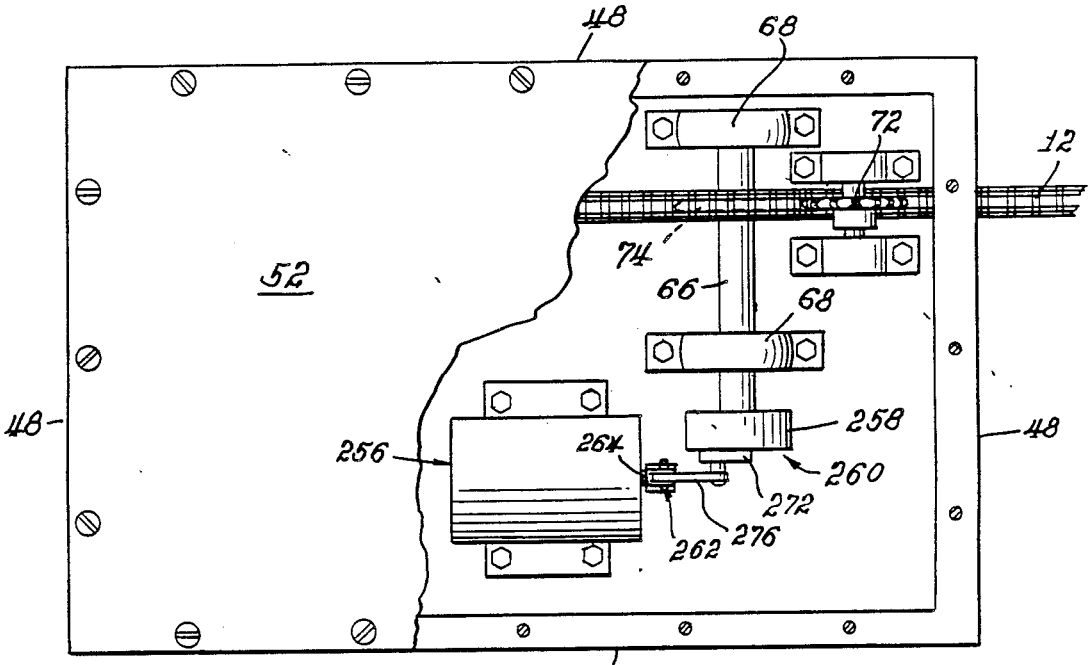
Fig. 16.
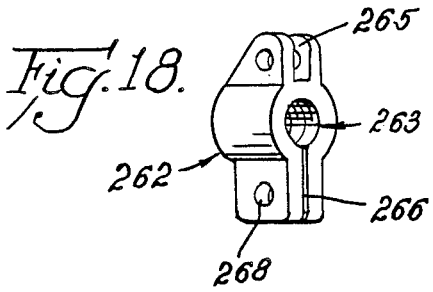
Fig. 18.
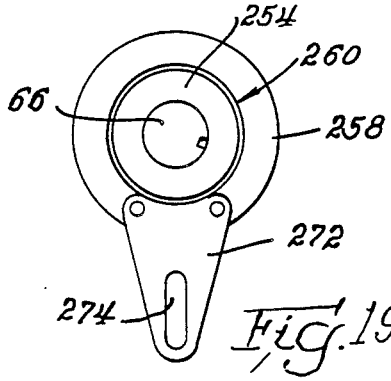
Fig. 19.
Fig. 17.
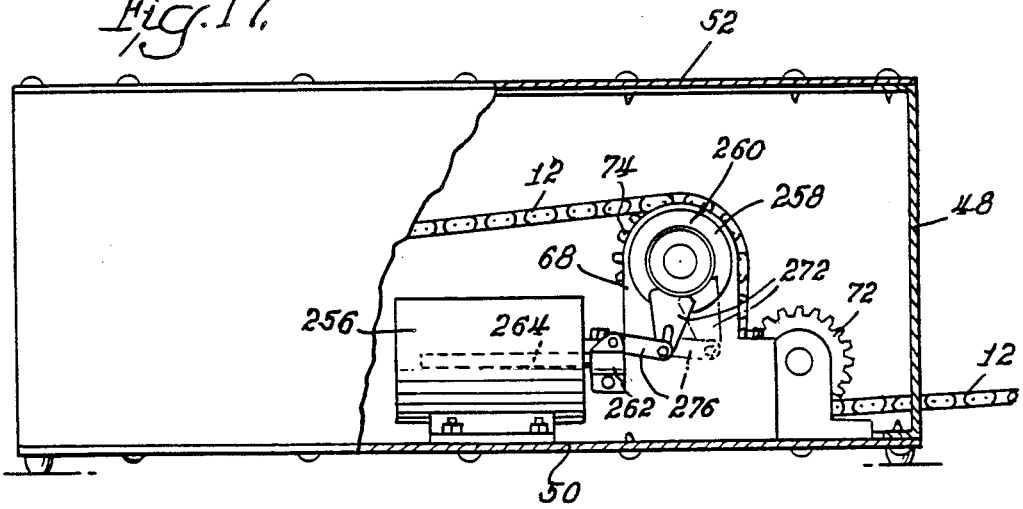

PULSE FORCE GENERATING AND LOADING EXERCISE DEVICE AND METHOD

This is a continuation of application Ser. No. 256,602, field Oct. 12, 1988, now abandoned.

BACKGROUND OF THE INVENTION

1. Field of the Invention

The present invention relates to exercise equipment, and more particularly refers to a method and device which may be used independently or in combination with conventional exercise regimen or equipment, and which device generates a series of pulse forces which are applied either directly or in combination with conventional exercise equipment to the muscles of a body member, e.g., a limb, trunk, foot, ankle, arm, leg, back, neck, or the like, of an exercising subject, thereby causing the muscles to stretch and to become stronger as a result of the stretching. The device and method of the present invention are able to generate a force in the contracting muscle greater than that attainable by voluntary contraction, which is a distinguishing feature which sets the present device and method apart from all previous exercise devices and methods. For example, according to the invention, a muscle is contracting at or near its maximum voluntary contractile force at a particular joint angle or position when a sudden pulse stretches the muscle a small distance, a stretching which results in a force in the muscle greater than that which could be voluntarily produced by the individual, the consequence being a greater strengthening effect than is attainable on any existing equipment or according to any available method.

2. Description of the Prior Art

There is general agreement among the authorities as expressed in the literature that, in order for a muscle to be strengthened, it must be loaded and that, for a muscle to be optimally strengthened, it must be overloaded or exercised until there is fatigue. This principle has been advanced over a long period of time. There is a story going back to the early Greeks, which tells of a man named Milo who lifted and carried a calf every day. As the calf gradually grew larger and heavier, Milo had to exert a greater force each day to carry the calf. Because the daily increasing force provided continually more severe exercise, Milo was able to carry the calf even after it had grown into a full-sized cow. There is also a classic article by an army colonel named Delorme who specifically looked at the use of barbells and so-called free weights to establish a regimen for overloading the muscle and thereby strengthening it. These are called "progressive resistance exercises".

There are basically several common types of exercises: (1) Isometric; and (2) Isotonic. In an isometric exercise the muscle contracts but the limb is held fixed against some object. The general concensus is that isometric exercises are limited in their ability to dramatically increase strength, and that the strength is only increased in the position in which the exercise is produced.

Isotonic exercises imply the contraction of muscle through a range of motion. Isotonic exercises may be subdivided into concentric and eccentric exercises. Concentric exercises are those in which the muscle shortens as force is applied: and eccentric exercises are those in which the muscle lengthens as force is applied.

An isotonic exercise may involve the use of a free weight such as a barbell or a weight machine.

In the past many weight machines have been developed and marketed by companies such as Universal, Nautilus, Paramount, Marcy, and a number of others. These weight machines generally apply a constant weight force to the joint throughout the entire range of motion. In the case of the Nautilus machine a variable resistance force is applied so that the resistance force applied to the limb is somewhat proportional to the mechanics of the average limb in terms of being able to generate force throughout the range of motion.

Some of the prior art devices referred to create resistance force by the use of weight stacks. Other devices use hydraulic resistance force, and still other devices utilize electromagnetic brakes in order to provide resistance force. This latter system is used by Cybex and by the new Paramount equipment as well as by Toro.

Other devices of the prior art have used vibrating beds or tables for release of congestion, prevention of decubitous ulcers, improvement of circulation, and relief of back pain. Other devices have utilized electrical stimulation. However, none of these devices has proven to be sufficiently effective in strengthening muscles.

SUMMARY OF THE INVENTION

It is an object of the invention to provide an exercise device to strengthen the muscles of a body member, e.g., a limb or the trunk, of an exercising subject.

It is a further object to provide a device of the type described which can more effectively strengthen the muscles of an exercising subject than can be accomplished with conventional exercise devices used alone.

It is still further an object to provide a device to accomplish the stated objects, which can be used either individually or in combination with conventional exercise equipment.

It is an additional object to provide a method for carrying out the stated objectives.

The foregoing and other objects, advantages and characterizing features will become apparent from the following description of certain illustrative embodiments of the invention, considered together with the accompanying drawings, wherein like reference numerals signify like elements throughout the various figures.

BRIEF DESCRIPTION OF INVENTION

According to the invention, exercise equipment is provided for exercising and strengthening the muscles of the body members of an exercising subject, which comprises body member-engaging means adapted to be engaged by a body member of the subject and to have the subject apply a moving force thereto in a certain direction, and means generating a series of pulse forces and applying them to the body member-engaging means in an opposite direction. The pulse forces are of sufficient magnitude to cause the body member-engaging means to move in small distance increments, thereby stretching the muscle of the subject with each pulse force movement. The present apparatus may be used by itself, or may be cooperatively coupled to conventional exercise equipment. As a result of the use of the present exercise equipment, the muscles of the body members of the exercising individual are stretched to a greater degree than when conventional equipment is used, resulting in the strengthening of the muscles so stretched to a greater degree than when conventional apparatus is used by itself.

SUMMARY OF INVENTION

The present invention is characterized, inter alia, by the following aspects, alone or in combination:

an exercise device comprising:

means for generating a series of mechanical pulse forces, and means for applying said mechanical pulse forces to a body member of an exercising subject, said pulse forces being of sufficient magnitude and duration to cause said body member to move a short distance with each pulse force, thereby causing the muscles of said body member to be stretched and strengthened; such an exercise device including mechanical means for generating mechanical force, clutch means for controlling the mechanical force transmitted from said mechanical means, electronic means for generating a series of electrical pulses, and said electronic means being operatively connected in said device to apply said electrical pulses to actuate a series of mechanical pulse forces of the same frequency and time period as said electrical pulses; such an exercise device wherein said mechanical means is a motor generating rotary motion, wherein said electronic means is electrically connected to said clutch means to cause said clutch means to transmit a series of rotary motion mechanical pulse forces, and wherein means is operatively connected to said clutch means for translating the rotary motion pulse forces transmitted by said clutch means to linear reciprocal motion applied as pulse forces to the body member of said subject; such an exercise device wherein said means for translating rotary motion to linear motion is a sprocket connected to said clutch means, and a chain engaged with said sprocket, one end of said chain being connected to a spring-loaded takeup means and the other end of said chain being connected to means engaged by the body member of said exercising subject; such an exercise device wherein said mechanical means is a rotary solenoid, both said rotary solenoid and said clutch means being electrically connected to said electronic means and adapted to receive a series of electrical pulses therefrom, and wherein means is connected to said clutch means for translating the rotary motion of said solenoid to linear reciprocal motion pulses applied as pulse forces to the body member of said subject; such an exercise device wherein said means for translating rotary motion to linear motion is a sprocket having a chain engaged thereon, one end of said chain being connected to a spring-loaded takeup means and the other end of said chain being connected to means engaged by the body member of said exercising subject; such an exercise device wherein said mechanical means is a linear solenoid electrically connected to said electronic means, and operatively connected to a sprag clutch having a sprocket connected to one end thereof, and a chain engaged with said sprocket, one end of said chain being connected to means engaged by the body member of said exercising subject; such an exercise device wherein the frequency of said pulse forces generated is from about 1 cycle per second to about 5 cycles per second; such an exercise device wherein the frequency of said pulse forces generated is about 3.8 cycles per second; such an exercise device wherein the time period of said pulse forces generated is from about 5 to about 100 milliseconds; such an exercise device wherein the time period of said pulse forces generated is from about 30 to about 50 milliseconds; such an exercise device wherein the distance through which said body member is moved through each pulse force is from about 2 millimeters to about 2 centimeters; such an exercise device wherein the distance through which said body member is moved through each pulse force is about 1 centimeter; such an exercise device wherein the angle through which said body member is caused to rotate about the axis of the joint thereof by each pulse force is from about ½ to about 10 degrees; such an exercise device wherein the angle through which said body member is caused to rotate about the axis of the joint thereof by each pulse force is about ½ to about 5, preferably about 2 degrees; such exercise equipment for exercising and strengthening the muscles of the body members of an exercising subject, comprising:

means for providing a primary resisting force in one direction, body member-engaging means operatively connected to said means providing said primary resisting force enabling the body member of said subject to exert a force in a direction opposite to that of said primary resisting force, and device for generating a series of mechanical pulse forces operatively connected to said equipment for superimposing said pulse forces on and in the same direction as said primary resisting force, whereby said body member is pulled back a distance in the direction of said primary resisting force with each pulse force, and whereby the muscles of the body member of said subject are stretched with each pulse force as said body member is moved and exercised, and ultimately strengthened thereby; such exercise apparatus wherein the means for providing said primary resisting force is a weight and associated transmission means, a portion of said transmission means being adapted to be engaged by the body member of said subject; such exercise equipment wherein said device includes:

mechanical means for generating mechanical force, clutch means for controlling the mechanical force transmitted from said mechanical means, electronic means for generating a series of electrical pulses, and said electronic means being operatively connected in said device to apply said electrical pulses to actuate a series of mechanical pulse forces of the same frequency and time period as said electrical pulses; such exercise equipment wherein said mechanical means is a motor generating rotary motion, wherein said electronic means is electrically connected to said clutch means to cause said clutch means to transmit a series of rotary motion mechanical pulse forces, and wherein means is operatively connected to said clutch means for translating the rotary motion pulse forces transmitted by said clutch means to linear reciprocal motion applied as pulse forces to the body member of said subject; such exercise equipment wherein said means for translating rotary motion to linear motion is a sprocket connected to said clutch means, and a chain engaged with said sprocket, one end of said chain being connected to a spring-loaded takeup means and the other end of said chain being connected to means engaged by the body member of said exercising subject; such exercise equipment wherein said mechanical means is a rotary solenoid, both said rotary solenoid and said clutch means being electrically connected to said electronic means and adapted to receive a series of electrical pulses therefrom, and wherein means is connected to said clutch means for translating the rotary motion of said solenoid to linear reciprocal motion pulses applied as pulse forces to the body member of said subject; such exercise equipment wherein said means for translating rotary motion to linear motion is a sprocket having a chain engaged thereon, one end of said chain being connected to a spring-loaded takeup means and the other end of said chain being connected to means engaged by the body member of said exercising subject; such exercise equipment wherein said mechanical means is a linear solenoid electrically connected to said electronic means, and operatively connected to a sprag clutch having a sprocket connected to one end thereof, and a chain engaged with said sprocket, one end of said chain being connected to means engaged by the body member of said exercising subject; such exercise equipment wherein the frequency of said pulse forces generated is from about 1 cycle per second to about 5 cycles per second; such exercise apparatus wherein the frequency of said pulse forces generated is about 3.8 cycles per second; such exercise apparatus wherein the time period of said pulse forces generated is from about 5 to about 100 milliseconds; such exercise apparatus wherein the time period of each of said said pulse forces generated is from about 30 to about 50 milliseconds; such exercise apparatus wherein the distance through which said body member is moved through each pulse is from about 2 millimeters to about 2 centimeters; such exercise apparatus wherein the distance through which said body member is moved through each pulse is about 1 centimeter; such exercise apparatus wherein the angle through which said body member is caused to rotate about the axis of the joint thereof by each pulse force is from about ½ to about 10 degrees; preferably about ½ to about 5 degrees; such exercise apparatus wherein the angle through which said body member is caused to rotate about the axis of the joint thereof by each pulse force is about 2 degrees; as well as a method for exercising and stretching the muscles of a body member of an exercising subject, which comprises:

generating a series of pulse forces, and applying said pulse forces to the body member of said subject while said body member is being exercised, the magnitude and duration of said pulse forces being sufficient to cause said body member to be drawn back a distance with each pulse force, thereby causing the muscles of said body member to be stretched; such a method for exercising and stretching the muscles of a body member of an exercising subject, which comprises:

applying a primary resisting force in one direction to said body member and forcing said subject to overcome said resisting force as said subject moves said body member in the opposite direction, generating a series of pulse forces, and superimposing said pulse forces on said primary resisting force in the same direction as that of said primary resisting force, the magnitude and duration of said pulse forces being sufficient to move said body member a short distance in the direction of said pulses and said primary resisting force with each pulse.

BRIEF DESCRIPTION OF THE DRAWINGS

A more complete understanding of the invention may be had by reference to the following detailed description when taken in conjunction with the accompanying drawings, wherein:

FIG. 1 is a diagrammatic view of an arm exerciser device according to the invention, wherein a weight is lifted by arm movement of the operator.

FIG. 2 is a diagrammatic view of a conventional exercising apparatus wherein the weight is lifted by the legs or by the arms, with the leg movement being the reverse of the arm movement illustrated in FIG. 1, and showing the pulse generating device of the present invention operatively connected thereto.

FIG. 16 is a top view, with the cover partly broken away, of still another embodiment of the pulse force generating device of the invention utilizing a linear or push type solenoid together with a reciprocating clutch device for providing the pulse force.

FIG. 17 is a side elevational view of the device shown in FIG. 16, with the side cover partly broken away.

FIG. 18 is a perspective view of a collar for operatively attaching the shaft of the linear solenoid to the clutch device; and FIG. 19 is a side elevational view of a clutch having an adjustable arm for connecting the clutch to the collar of FIG. 18 by means of a connecting link.

DESCRIPTION OF THE PREFERRED EMBODIMENTS

Figure 3:
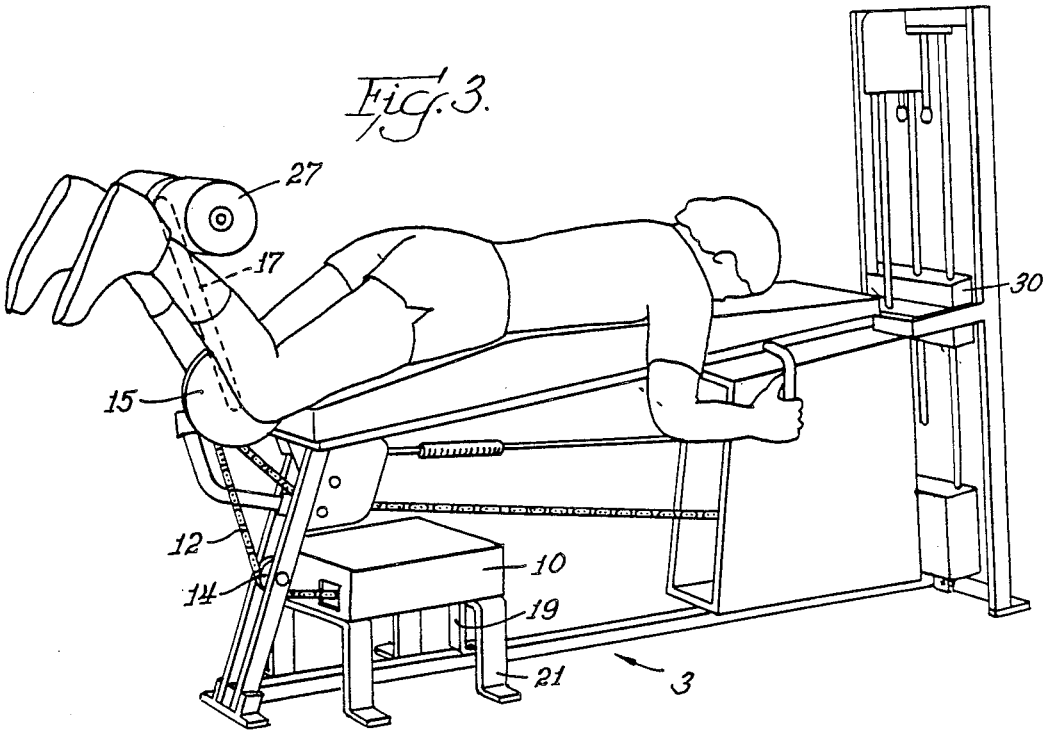
FIG. 3 is a diagrammatic view of a conventional exercise apparatus of a leg-curl type, having the pulsating device of the present invention operatively connected thereto.

Referring to FIG. 1, exercise equipment 1 is shown in diagram having a body member engagement means such as a hand grip 20 attached to a lever 22 which is pivotable about a pivot 24 from the position shown in solid lines to the position shown in broken or shadow lines. Movement of the lever 22 by the operator causes a weight 30 to be lifted by an actuating cable 26 which is anchored to the lever 22 by a cable anchor 25, and which extends around pulleys 28. A pulse force generating device 10 according to the invention is shown having a cable 12 extending therefrom, one end of which is secured to the lever arm 22 by a cable anchor 25*a*.

In the exercise apparatus shown diagrammatically in FIG. 1, the arm of a human operator is shown pulling hand grips 20 attached to the lever 22 pivoted at 24 and attached above the midpoint of the lever 22 to the cable 26 which is trained under and over a series of pulleys 28 to the weight 30. Movement of the arm from the solid line position toward the broken or phantom line position raises the weight 30, the weight in this case being the primary resisting force. The pulse force creating device 10 of the present invention is operatively connected by means of the chain 12 to the lever 22 at the point 25*a* below connection 25. In operation the pulse force creating device 10 creates and superimposes a series of short pulse forces in the direction of the resisting force generated by the weight 30, and in a direction opposite to that exerted by the exercising subject and of sufficient magnitude and over a sufficient distance to move the limb of the subject being exercised a short distance in the direction of the resisting force, thereby causing the muscle of the limb of the subject to be stretched.

Referring to FIG. 2, a complete conventional exercise apparatus 10 is shown, comprising a frame 2, and a weight carriage 18 connected by cables 32 to an eccentric pulley 34. L-shaped arms 36 are affixed to the pulley 34 and are adapted to be engaged by body members such as limbs of the exercising subject. A foot-engaging member 38 is mounted on levers 40 affixed to a pivot 42, and at the distal end to rollers 44 mounted on rails 46. A weight 30 is mounted on the weight carriage 18.

A pulse force generating device 10 is mounted on the frame 2. A cable 12 extends from an aperture in the case of the device 10, riding on a pulley 14 and being connected at its end to a cable anchor arm 16. When the device 10 is activated, it creates a series of impulse forces which are superimposed on the resisting force created by the weight 30 and in the same direction as the resisting force. The impulse forces are of such magnitude and applied over a sufficient distance to cause the limb of the subject to be pulled back a short distance with each pulse, thereby stretching the muscles of the limb of the subject.

The legs of the exercising subject may also be exercised by exerting pressure of the feet on the feet-receiving end 38 of lever 40 which is pivoted at 42, and having rollers 44 at the opposite end thereof which bear upwardly against track 46 of the weight-carriage.

Referring to FIG. 3, a leg-curl apparatus 3 marketed under the trademark "Nautilus TM" is shown, having a pulse force-generating device 10, according to the invention. Nautilus TM equipment is manufactured and marketed by Nautilus Sports/Medical Industries, Deland, Fla. The device 10 has has a chain or cable 12 trained under pulley 14 and wound onto spool 15 along with a cable to the control portion of the exerciser 3, the chain or cable 12 being associated with the actuating pads 27 by an arm 17. The pulse force-generating device 10 is anchored to the frame of the exercise apparatus 3 by a bracket 19 and supported by legs 21. The device 10 produces a continuous series of pulse forces in the same direction as the resisting force produced by the weights 30 of the exercise equipment and of sufficient magnitude to cause the limbs of the exercising subject to be pulled back a short distance with each pulse in a direction opposite to that in which the subject exerts force.

Figure 4:
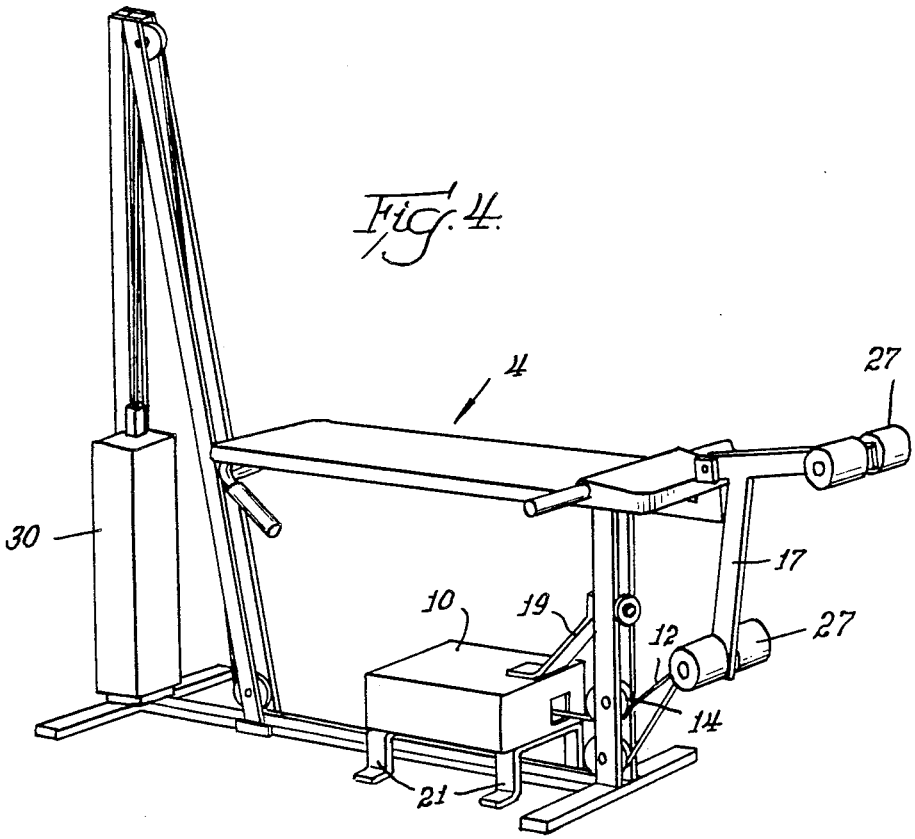
FIG. 4 is a diagrammatic view of the pulsating device of the present invention operatively connected to a conventional leg flexion/extension exercise apparatus.

Referring to FIG. 4, a "NAUTILUST TM" leg flexion/extension machine 7070 apparatus 4 is shown. A pulse force-generating device 10, according to the invention, is mounted on the apparatus 4 by an attachment bracket 19 and supported by legs 21. A chain or cable 12 rides on a pulley 14 and is connected at its end to an arm 17 which supports foot-engaging pads 27. The weight 30*a* of the apparatus provides the primary resisting force, and the pulse forces generated by the device 10 are superimposed thereon. The operation of the equipment is similar to that described with respect to the equipment of FIG. 3.

Figure 5:
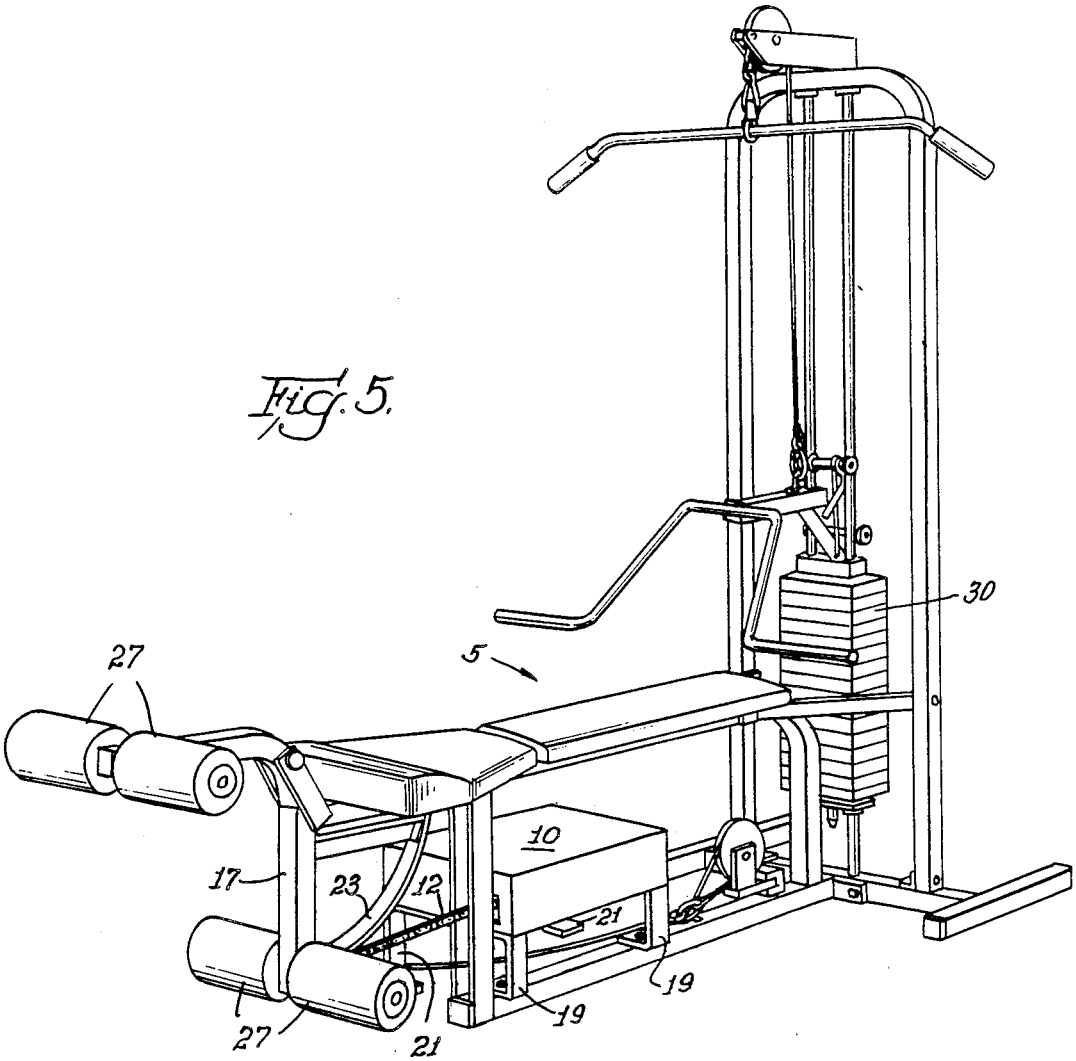
FIG. 5 is a diagrammatic view of the pulsating device of the present invention operatively connected to another type of weight-lifting apparatus.

Referring to FIG. 5, a "PARAMOUNT FITNESS MATE TM" apparatus 5 is shown. Paramount TM equipment is manufactured and marketed by Paramount Fitness Equipment, Los Angeles, Calif. A pulse force-generating device 10, according to the invention, is anchored to the frame of the apparatus 5 by legs 19 and 21. A chain or cable 12 extends from an aperture in the frame of the device 10 and has one end joined to the end of an arcuate member 23 which swings with an arm 17 which supports foot-engaging pads 27. The chain or cable 12 is trained around the bottom side of the arcuate member 23, thus maintaining the chain or cable 12 horizontally oriented as it feeds in and out of the device 10, thereby eliminating the need for a pulley such as the pulley 14 used in the apparatus of FIG. 4. A weight 30 provides the primary resisting force. The operation of the device 10 of FIG. 5 is similar to that of the device 10 of FIGS. 3 or 4.

Figure 6:
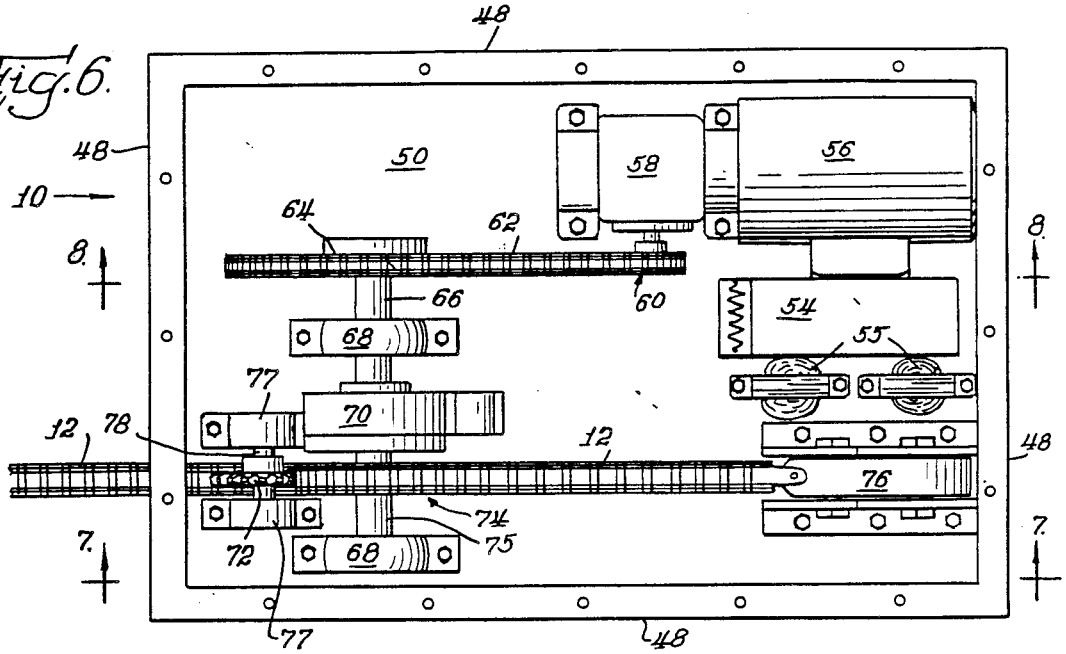
FIG. 6 is a top view of the pulsating device of the present invention with top cover removed.
Figure 7:
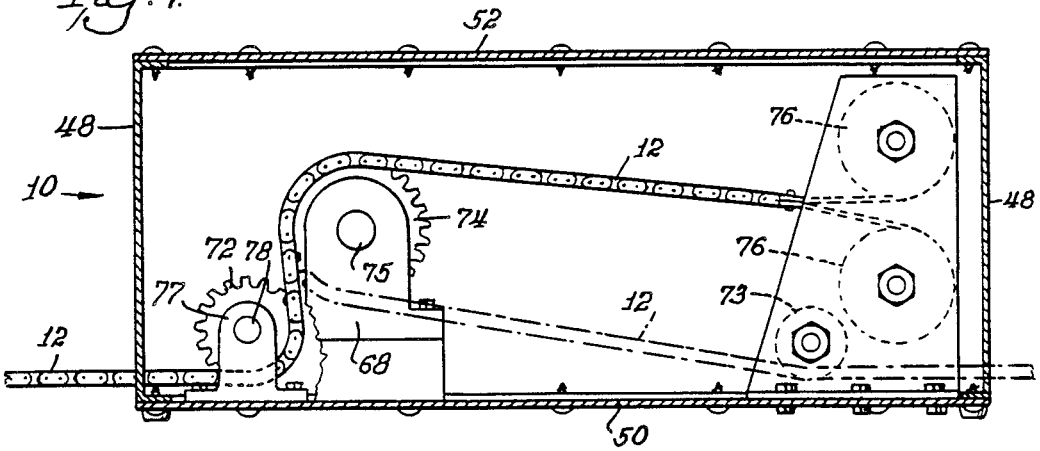
FIG. 7 is a cross-sectional view taken at the line 7—7 of FIG. 6, looking in the direction of the arrows.
Figure 8:
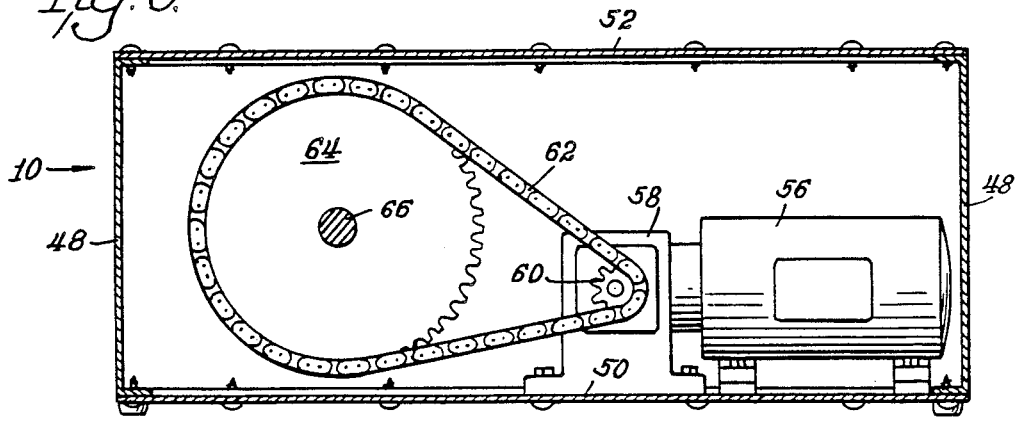
FIG. 8 is a cross-sectional view taken at the line 8—8, looking in the direction of the arrows.

Referring to FIGS. 6–8, one embodiment of the device 10 is shown in greater detail, and comprises a housing formed of side walls 48, a bottom wall 50 and a top wall 52. An electronic driver 54 powered by transformers 55 controls the sequencing of electrical pulses which activate the generation of pulse forces. An electrical motor 56 drives a speed reducer 58 which in turn drives a sprocket 60 The sprocket 60 in turn drives a chain 62 which drives a sprocket 64. The sprocket 64 is affixed to the end of a shaft 66 which is journaled in a bearing 68, and is connected at its other end to an electromagnetic clutch 70. An extension shaft segment 75 extends from the clutch 70 in coaxial arrangement with respect to the shaft 66, and is journaled in another bearing 68. A sprocket 74 is affixed to the shaft segment 75. A chain 12 has one end connected to a constant torque spring 76, e.g., one manufactured by the Vulcan Mfg. Co., Philadelphia, Pa. The constant torque spring 76 maintains a constant rearward force on the end of the chain 12, while permitting the chain to move in either direction. The chain 12 is engaged over the sprocket 74, under an idler sprocket 72 mounted on a shaft 78 which is journaled in a pair of bearings 77, and which chain exits from the housing of the device 10 through an aperture provided in one of the side walls 48. Alternatively, the chain 12 may be reversed, as shown in broken lines, being guided by an idler sprocket 73, and exiting through an aperture provided in another sidewall 48.

In operation, electricity is applied to the motor 56 which in turn operates the speed reducer 58 causing the sprocket 60 to rotate and to drive the chain 62, which in turn drives the sprocket 64 and the shaft 66. Under normal conditions the clutch 70 maintains the shaft segment 75 disconnected from the shaft 66. In this condition the chain is free to move backward or forward as moved by the exercise apparatus to which it is connected. However, during operation of the pulse force-generating device 10, the electronic driver 54 generates a series of electrical impulses which are applied to the electromagnetic clutch 70, causing the sprocket 74 to rotate through a small angle and to drive the chain a short distance with each impulse generated, and to superimpose a series of pulse forces on the exercise apparatus in the direction of the resisting force generated by the weights of the apparatus, and in a direction opposite to the direction of the force applied by the exercising subject against the body member-engaging means of the apparatus. The superimposed pulse forces thus applied are of sufficient force and extend over a sufficient distance to cause the body member such as the arm to be drawn back in a direction opposite to that of the direction of the force applied by the exercising subject, causing the muscles to stretch a short distance with each pulse and thereby strengthening the muscles over a period of time. The parameters of the electronic controller 54 may be suitably set so that the rotation of the shaft 75 is interrupted and reversed at a rate of approximately 3.8 cycles per second, the duration of the reversed motion being in the range of from about 30 to about 50 milliseconds.

Figure 9:
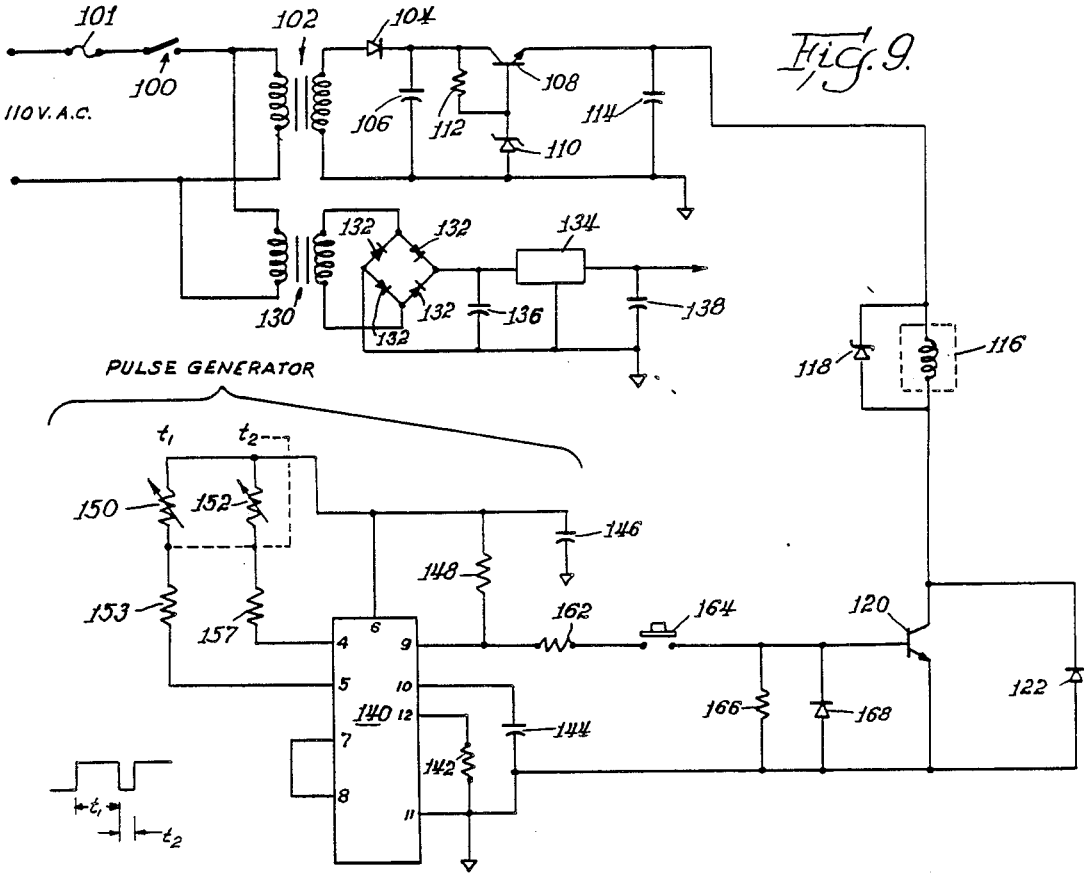
FIG. 9 is a diagrammatic view of the electrical circuitry present in the pulsating device of the invention shown in FIGS. 6–8.

Referring to FIG. 9, a schematic diagram of the electronic driver 54 controlling the pulse force generating device 10 is shown. The circuit includes a half wave regulated power supply for exciting the clutch 70 comprising a switch 100, a fuse 101, and a power transformer 102. The output from the secondary winding of the transformer 102 is fed through a diode 104, by-passed by a filter capacitor 106, and fed to a voltage control circuit including an NPN transistor 108 having a by-pass resistor 112 and a zener diode 110. The output current from the power supply is by-passed by a capacitor 114 and connected to one terminal of a clutch 16, identical to the clutch 70 illustrated in FIG. 6. The clutch 116 is by-passed by a diode 118 and connected through a control transistor 120 to ground. A diode 122 by-passes the transistor 120.

A power supply for the pulse generator of the device 10 is also included in the circuit diagram of FIG. 9, and comprises a second power transformer 130 and a full wave bridge rectifier formed of four diodes 132. A filter for the power supply comprises a choke coil 134 and a pair of capacitors 136 and 138. The output from the power supply is connected to the pulse generator circuit proper by an input capacitor 146 by-passed to ground by a capacitor 136. The electrical current passing through the capacitor 146 is connected to a front panel adjustment circuit comprising a pair of variable resistors 150 and 152 for controlling the parameters of the electrical pulse which controls the action of the clutch 116. The current from the resistors 150 and 152 passes through resistors 153 and 157 and is introduced into terminals 4 and 5 of an integrated circuit 140. Terminal 10 of the integrated circuit is by-passed by a capacitor 144, and terminal 12 is by-passed by a resistor 142. The pulse output signal is passed through a resistor 162, through an external push button 164, and connected to the base of the control transistor 120. The graph beside the integrated circuit shows the time parameters controlled by the variable resistors 150 and 152.

Figure 10:
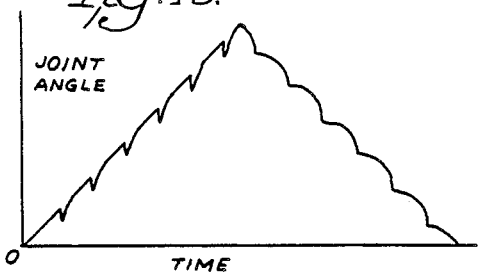
FIG. 10 is a graph showing the effects on joint angle of an exercising limb as the limb is extended and then on the joint angle of the limb as the limb is flexed, as a function of time, according to the pulse generating device and method of the present invention.

Referring to FIG. 10, a graph is shown in which the angle of the body member or limb of an exercising subject is plotted against time. The increase in angle represents the movement of the limb as it is exerting force against the resisting force created by th weight of the exercise apparatus. The small downward movements represent the rearward movement of the limb as it is drawn back by the force of the pulse force created by the pulse force-creating device of the present invention and superimposed on the resisting force created by the weights of the machine. The portion of the graph which shows the angle of the limb decreasing represents the joint angle of the subject as it changes when the subject decreases its force on the apparatus and permits the apparatus to pull its limb back slowly while the pulse forces are still superimposed on the resisting force of the weights. Although the rearward motion caused by the superimposition of the pulse forces has been shown in the graph as causing angle changes at a uniform rate, it will be apparent that the angular rate of change may increase or decrease due to the change of the geometric relationships of the limbs during various types of exercise and/or where different types and sizes of limbs are involved.

Figure 11:
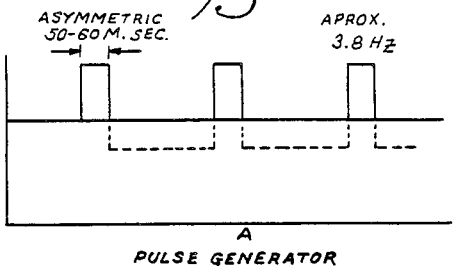
FIG. 11 is a graph showing the time sequence of pulses produced by the present pulse generating device.

Referring to FIG. 11, a graph is provided showing the parameters of the square wave electrical pulses generated by the apparatus having the circuit shown in FIG. 9. As shown, the pulses used to operate the clutch are half wave portions of a square wave alternating current, with the on-current portions of the pulse being of shorter duration than the off-current portions. One set of parameters for suitable operation is shown as 50–60 milliseconds at approximately 3.8 Hz.

Figure 12:
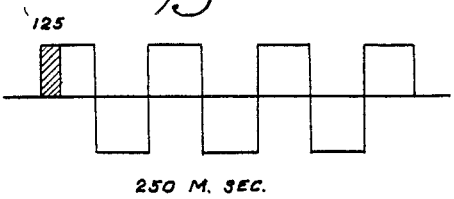
FIG. 12 is a graph showing how the pulse is split, according to the invention.

Referring to FIG. 12, a diagram of a square wave alternating current is shown which constitutes the basis for the generation of the current pulses shown in FIG. 11. The electronic circuit shown in FIG. 9 accomplishes the removal of the negative component of the current and, by manipulation of the variable resistors 150 and 152, produces the proper relationship between the on-current period and the off-current period.

Figure 13:
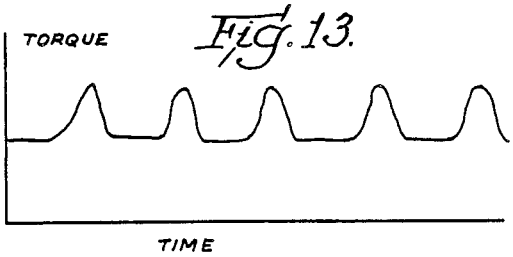
FIG. 13 is a graph showing the relationship of torque movement to time, when utilizing the pulsating force device according to the present invention.

Referring to FIG. 13, a graph is shown depicting the superimposition of the periodic pulse forces according to the invention on the resisting force produced by the weights of the apparatus to produce an overall torque acting against the limb of the subject.

Table I below contains a listing of the numeral designations and values or descriptions of the components utilized in the electronic circuit shown in FIG. 9.

TABLE I

| Numeral designation | Value or description |
|---|---|
| 102 | Power transformer F-283u |
| 104 | Diode |
| 106 | Capacitor 500 mfd. |
| 108 | Transistor 2N5682 |
| 110 | Zener diode 1N4763 |
| 112 | Resistor 2.7k |
| 114 | Capacitor 500 mfd. |
| 116 | Clutch |
| 118 | Zener diode 1N5818 |
| 120 | Transistor 2N5682 |
| 122 | Diode |
| 130 | Power transformer F-70X |
| 132 | Diodes |
| 134 | Choke coil 7812 |
| 136 | Filter capacitor 100 mfd. |
| 138 | Filter capacitor 100 mfd. |
| 140 | Integrated circuit ICL 8038 |
| 142 | Resistor 82K |
| 144 | Capacitor 10 mfd. |
| 146 | Capacitor 0.1 mfd. |
| 148 | Resistor 2.2K |
| 150 | Variable resistor 250K |
| 152 | Variable resistor 250K |
| 154 | Resistor 100K |
| 156 | Resistor 100K |
| 162 | Resistor 1K |
| 164 | Push button |
| 168 | Diode |

Figure 14:
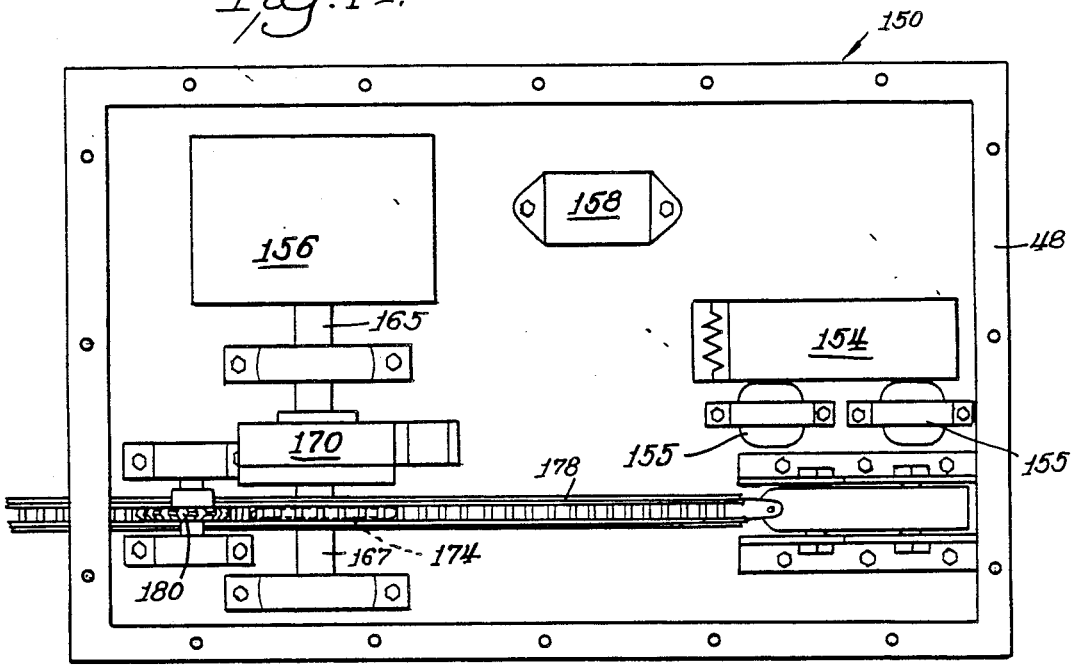
FIG. 14 is a top view of another embodiment of a pulse force generating device according to the present invention utilizing a rotary solenoid and clutch to provide the pulsating forces.
Figure 15:
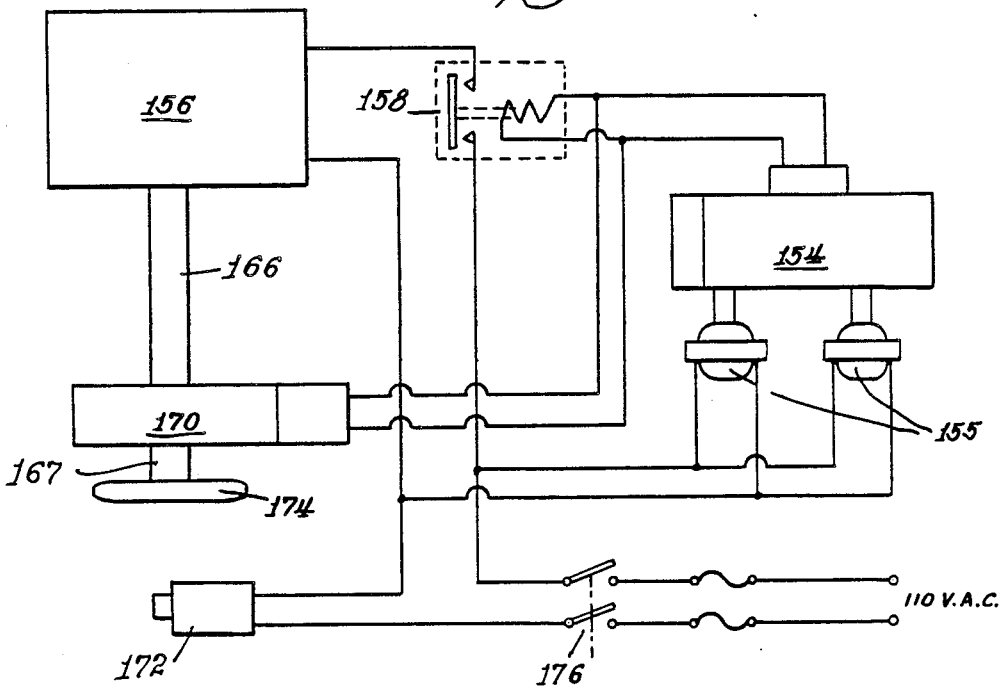
FIG. 15 is a diagrammatic view of the pulsating force device shown in FIG. 14, showing in detail the electrical circuit utilized to to control the operation of the device.

Referring to FIGS. 14 and 15, a pulse force generating device is illustrated which utilizes a rotary solenoid for generating the required force instead of an electric motor and speed reducer. The device is housed in an enclosure 48 similar to that utilized to house the device of FIGS. 6–8. The rotary solenoid 156 provides rotating force which is transmitted by a shaft 166 to a clutch 170. Power from the other side of the clutch is transmitted by a shaft 167 to a sprocket 174. A chain 178 is engaged over the sprocket 174, and retained in position by an idler sprocket 180. The chain 178 has one end adapted to be connected to an exercise apparatus, and has the other end connected to a constant torque spring 182. An electrical pulse generator 154, similar to that of the pulse generator 54 of FIGS. 6–8, and having the circuit shown in FIG. 9, is powered by transformers 155. The pulse signal current from the pulse generator 154 actuates a relay 158 which closes the circuit supplying 110 volts A.C. current to the solenoid 156. The current supplied to the solenoid 156 is also controlled by a hand operated remote switch 172. The pulse signal current also actuates the clutch 170. As a result, with each pulse the solenoid is caused to rotate through a small angle, and the clutch causes that movement to be transmitted to the chain. Between pulses the chain 178 is free to move in either direction.

Referring to FIGS. 16–19, still another embodiment of the invention is illustrated, contained in an enclosure comprising side walls 48, a bottom 50, and a top 52, similar to that of the embodiment shown in FIGS. 6–8. The device has a chain 12 mounted over a sprocket 74 affixed to a shaft 66 which is journaled in bearings 68. A sprag collar 254 of a clutch 260 is affixed to the end of the shaft 68. The clutch 260 is an overrunning type clutch, similar to a free-wheeling clutch in an automobile. Some types are known as sprag clutches. These clutches engage instantaneously in one direction, and are free to rotate in the other direction. In the sprag type clutch the sprags are spring-biased toward engagement with the clutch surface. In FIG. 16, an outer collar 258 of the clutch 260 engages the sprag collar 254 when the collar 258 is rotated counter-clockwise, as viewed in FIG. 17.

In FIG. 16, the solenoid 256 is shown connected by means of a collar 262 to a shaft 264, also shown in FIG. 17. The collar 262 is connected to one end of a connecting link 276, the other end of the link being connected to an adjustable arm 272.

Referring to FIG. 18, a perspective view of the collar 262 is shown. The collar has a central aperture 263 which is provided with threads for threading onto the shaft 264 which is provided at its end with complementary threads, in order to permit adjustment. The collar 262 is provided with a slit 266 in order to permit tightening of the collar about the shaft 264 by means of a bolt and nut (not shown), the bolt being placed in an aperture 268 and tightened by engagement with the nut.

Referring to FIG. 19, the clutch 260 is shown having an adjustable arm 272 connected to the collar 258. A slot 274 is provided to adjust the degree of angular movement imparted to the shaft 66 by the throw of the solenoid 256.

The solenoid 256 is actuated by a pulse generator similar to that shown in FIGS. 14 and 15. With each pulse the linear solenoid 256 causes the shaft 66 to rotate through a small angle. During the period that the pulse is off, the shaft 66 is free to rotate, and the chain 12 is free to move in either direction.

In operation of the pulse force generating device shown in FIGS. 16–19, a pulse generator (not shown but similar to that shown in FIGS. 6–9, 14 and 15), provides electrical impulses which are applied to the solenoid 256. The shaft 264 moves with each impulse and throughout the entire period of the impulse, causing the clutch 260 to be engaged, and thereby rotating the shaft 66. The shaft 66 rotates the sprocket 74 which causes the chain 12 to move. During the time period when no electrical impulse is being applied to the solenoid 256, the clutch 260 is released and the sprocket 74 and chain 12 move freely. One end of the chain 12 is connected to the exercising apparatus with which it is used. Consequently, each time the chain moves it transmits a pulse force generated by the device to the exercising equipment to which it is connected. This pulse force is superimposed on the resisting force generated by the weights of the exercising equipment. The pulse force so superimposed in a direction opposite to that of the force applied by the exercising subject causes the muscles of the subject to be stretched and, over a period of time, strengthened thereby.

The present invention is based on the known fact that muscle hypertrophies or strengthens when fatigued. This phenomenon depends on many factors, one of which is the neurologic stimulus to the muscle, another being the load applied to the muscle. It is commonly accepted that the application of a significant weight or torque resistance to motion is necessary for strengthening of the muscle. In essence, what is being accomplished is that the muscle is contracting and to some extent stretching out to achieve lifting. To some extent, the degree of loading determines the strengthening effect of exercising.

There is growing experimental evidence that prestretching or stretching of a muscle prior to or during muscular activation results in greater force being generated by the muscle. In turn it could be argued that the greater force which the muscle applies would therefore lead to a greater training effect. Experimentally, animals have been subjected to artificial stimulation of the muscle and then to sudden stretching of the muscle to quantify the increase in force generated by the muscle. There is widespread experimental evidence that this in fact occurs.

Clinically, one technique for muscle strengthening called depth jumping or plyometrics has been applied for a considerable time by scientists in the Soviet Union. In essence, this training technique consists in having an individual jump down from a height, thereby suddenly stretching the muscle, allowing the individual to then spring back with greater force. In essence, in the individual the musculotendinous system absorbs energy, converting kinetic energy to potential energy, the potential energy then being reconverted to motion. While this technique has been shown to have a beneficial effect, it has a significant disadvantage in that the effect occurs only at one point in the motion of the muscle or limb, and is not applicable to the full range of motion of the muscle or extremity of the individual. It constitutes a single uncontrolled impulse and accordingly presents the potential for damage to the muscle and tendons which the system of the present invention does not.

In the use of conventional exercise equipment, a resisting force is generated in the equipment, usually by weights or springs or other means. This force is applied to a body member-engaging means such as a hand grip or a foot-engaging pedal. The limb of the exercising subject engages the grip or pedal or other means and applies a moving force opposite to that of the resisting force of the apparatus and moves it in the direction of the moving force, and then in return.

According to the present invention, a series of pulse forces is generated and superimposed on the resisting force of the apparatus in the direction of the resisting force and opposite in direction to the force applied by the subject. Under normal operation the moving force applied by the subject is sufficiently great to overcome the resisting force of the apparatus. However, the sum of the resisting force of the apparatus and the force of the pulse is sufficiently great to overcome the moving force of the subject, thereby causing the limb of the subject to be drawn back a short distance with each pulse, and thereby stretching the muscle with each pulse.

The pulsating force generating device of the present invention may be used in one of two ways. First it may be used by itself. For example, the device 10, such as shown in FIGS. 6–8, may have the end of the chain 12 connected to a body member-engaging means such as a hand grip. The pulse force generator would then apply the pulse forces directly against the limb of the subject. The subject would move his limb back and forth with little or no resistive force applied by the device. However, with each pulse, the limb of the subject would be pulled back a short distance, thereby stretching the muscles. In the second method of using the pulse force-generating device of the invention, the end of the chain 12 is connected to a conventional exercising apparatus, as shown in FIGS. 1–5. In this method the pulse forces are superimposed on the resisting force of the apparatus. The pulse forces are applied in the same direction as the resisting force of the apparatus and opposed to the direction of the force applied by the exercising subject.

With regard to the parameters of the pulse force, the frequency of the pulse should be from about 1 to about 5 cycles per second. It has been determined that a frequency of about 3.8 cycles per second is optimum. The duration of the pulse may be in the range of from about 5 to about 100 milliseconds. A range of from about 30 to 50 milliseconds has been found to be optimum. The direction of movement should be opposite to the direction of the force applied by the exercising subject. Consequently, when the subject is moving the apparatus against the resisting force of the exercise apparatus, the exercising limb will be pulled back by the pulse force. When the subject is releasing the apparatus in the direction of the resisting force of the apparatus, the effect of the pulses will be to jerk the limb of the subject a small distance in the direction of the pulling force of the apparatus.

With regard to the question of safety during the exercise accompanied by the pulse forces, it has been found that backward movements of the engaging portion of the exercising limb of from about 2 mm. to about 2 cm. are perfectly safe, and that a movement of about 1 cm is optimum. Transferred into angular movement of the limb, it has been found that an angular movement of from about 0.5 deg. to about 10 deg. represents a safe range, and that an angular movement of about 2 deg. is optimum.

In conclusion, from the foregoing, it is apparent that the present invention provides a novel exercise device and a novel combination of the device with conventional exercise apparatus, and a novel method for exercising the body members of an exercising subject. The novel device comprises a means for generating a series of pulse forces which, when applied to the body member of the exercising subject, results in the stretching of the muscles of the body member within effective and safe limits. The present device may also used in combination with conventional exercise apparatus and, when so used, results in the superimposition of pulse forces on the primary resisting force of the conventional apparatus. As a result, when the body member of the exercising subject is moved in opposition to the resisting force, the body member is pulled a short distance in the direction of the pulse forces with each pulse force. As a result, the body member muscles are stretched within safe and acceptable limits and results in the ultimate strenghtening of the muscles so stretched to a greater degree than could be accomplished by the use of the conventional apparatus by itself. The invention also resides in the method of generating the pulse forces according to the invention and applying them to the exercising body member of the subject in order to stretch and strengthen the muscles thereof.

It is to be understood that the invention is not to be limited to the exact details of operation, or to the exact methods, procedures, or embodiments shown and described, as obvious modifications and equivalents will be apparent to one skilled in the art, and the invention is therefore to be limited only by the full scope which can be legally attributed to the appended claims.

I claim:

1. An exercise device comprising:

means for generating a series of mechanical pulse forces solely in one direction, and means for directly engaging a body member of an exercising subject and applying said series of mechanical pulse forces directly to said body member and for moving with said body member while the body member is applying force in a certain direction, said pulse force being of sufficient magnitude, direction, and duration to cause said body member to move a short distance with each pulse force in a direction opposite to said certain direction in which said body member is applying force, thereby causing the muscles of said body member to be stretched and strengthened.

2. An exercise device having means for generating a series of mechanical pulse forces comprising:

mechanical means for generating mechanical force, clutch means for controlling the mechanical force transmitted from said mechanical means, electronic means for generating a series of electrical pulses, said electronic means being operatively connected in said device to apply said electrical pulses to actuate a series of mechanical pulse forces of the same frequency and time period as said electrical pulses, and means for operatively applying said series of mechanical pulse forces to a body member of an exercising subject while the body member is applying force in a certain direction.

3. An exercise device according to claim 2, wherein the frequency of said pulse forces generated is from about 1 cycle per second to about 5 cycles per second.

4. An exercise device according to claim 2, wherein the frequency of said pulse forces generated is about 3.8 cycles per second.

5. An exercise device according to claim 2, wherein the time period of said pulse forces generated is from about 5 to about 100 milliseconds.

6. An exercise device according to claim 2, wherein the time period of said pulse forces generated is from about 30 to about 50 milliseconds.

7. An exercise device according to claim 2, wherein the distance through which said body member is moved through each pulse is from about 2 millimeters to about 2 centimeters.

8. An exercise device according to claim 2, wherein the distance through which said body member is moved through each pulse is about 1 centimeter.

9. An exercise device according to claim 2, wherein said mechanical means is a motor generating rotary motion, wherein said electronic means is electrically connected to said clutch means to cause said clutch means to transmit a series of rotary motion mechanical pulse forces, and wherein means is operatively connected to said clutch means for translating the rotary motion pulse forces transmitted by said clutch means to linear reciprocal motion pulse forces, and applied to said means for operatively applying said pulse forces to the body member of said subject.

10. An exercise device according to claim 9, wherein said means for translating rotary motion to linear motion is a sprocket connected to said clutch means, and a chain engaged with said sprocket, one end of said chain being connected to a spring-loaded take-up means and the other end of said chain being operatively connected to said means for engagement by the body member of said exercising subject.

11. An exercise device according to claim 2, wherein said mechanical means is a rotary solenoid, both said rotary solenoid and said clutch means being electrically connected to said electronic means and adapted to receive a series of electrical pulses therefrom, and wherein means is connected to said clutch means for translating the rotary motion of said solenoid to linear reciprocal motion pulse forces and operatively applying said pulse forces to the body member of said subject.

12. An exercise device according to claim 11, having said for engagement by the body member of an exercising subject, wherein said means for translating rotary motion to linear motion is a sprocket having a chain engaged thereon, one end of said chain being connected to a spring-loaded takeup means and the other end of said chain being operatively connected to said means for engagement by the body member of said exercising subject.

13. An exercise device according to claim 2, having said means for engagement by the body member of an exercising subject, and wherein said mechanical means is a linear solenoid electrically connected to said electronic means, wherein said clutch means is a sprag clutch having a sprocket connected to one end thereof and having said solenoid operatively connected to the other end thereof, and a chain engaged with said sprocket, one end of said chain being connected to said means for engagement by the body member of said exercising subject.

14. An exercise device according to claim 2, wherein said means for applying said mechanical pulse forces to the body member includes means for rotating said body member about the axis of the joint thereof by each pulse force from about ½ to about 10 degrees.

15. An exercise device according to claim 2, wherein said means for applying said mechanical pulse forces to the body member includes means for rotating said body member about the axis of the joint thereof by each pulse force about 2 degrees.

16. An exercise device according to claim 2, wherein said means for applying said mechanical pulse forces to the body member includes means for rotating said body member about the axis of the joint thereof by each pulse force about ½ to about 5 degrees.

17. Exercise equipment for exercising and strengthening the muscles of the body members of an exercising subject, comprising:

means for providing a primary resisting force in one direction, body member-engaging means operatively connected to said means providing said primary resisting force enabling the body member of said subject to exert a force in a direction opposite to that of said primary resisting force, and device for generating a series of mechanical pulse forces operatively connected to said equipment for superimposing said pulse forces on and in the same direction as said primary resisting force, the frequency of said series of pulse forces being greater than the frequency of the stroke of the body member against the primary resisting force, whereby said body member is pulled back a distance in the direction of said primary resisting force with each pulse force and whereby the muscles of the body member of said subject are stretched with each pulse force as said body member is moved and exercised, and ultimately strengthened thereby.

18. Exercise apparatus according to claim 17, wherein said device for generating a series of mechanical pulse forces includes:

mechanical means for generating mechanical force, clutch means for controlling the mechanical force transmitted from said mechanical means, electronic means for generating a series of electrical pulses, and said electronic means being operatively connected in said device to apply said electrical pulses to actuate a series of mechanical pulse forces of the same frequency and time period as said electrical pulses.

19. Exercise equipment according to claim 18, wherein said mechanical means is a linear solenoid electrically connected to said electronic means, and operatively connected to a sprag clutch having a sprocket connected to one end thereof, and a chain engaged with said sprocket, one end of said chain being operatively connected to said body-member engaging means.

20. Exercise equipment according to claim 18, wherein said mechanical means is a motor generating rotary motion, wherein said electronic means is electrically connected to said clutch means to cause said clutch means to transmit a series of rotary motion mechanical pulse forces, and wherein means is operatively connected to said clutch means for translating the rotary motion pulse forces transmitted by said clutch means to linear reciprocal motion applied as pulse forces to the body member of said subject.

21. Exercise equipment according to claim 20, wherein said means for translating rotary motion to linear motion is a sprocket connected to said clutch means, and a chain engaged with said sprocket, one end of said chain being connected to a spring-loaded take-up means and the other end of said chain being connected to means engaged by the body member of said exercising subject.

22. Exercise equipment according to claim 18, wherein said mechanical means is a rotary solenoid, both said rotary solenoid and said clutch means being electrically connected to said electronic means and adapted to receive a series of electrical pulses therefrom, and wherein means is connected to said clutch means for translating the rotary motion of said solenoid to linear reciprocal motion pulses applied as pulse forces to the body member of said subject.

23. Exercise equipment according to claim 22, wherein said means for translating rotary motion to linear motion is a sprocket having a chain engaged thereon, one end of said chain being connected to a spring-loaded take-up means and the other end of said chain being connected to means engaged by the body member of said exercising subject.

24. Exercise equipment according to claim 18, wherein the frequency of said pulse forces generated is from about 1 cycle per second to about 5 cycles per second.

25. Exercise apparatus according to claim 18, wherein the frequency of said pulse forces generated is about 3.8 cycles per second.

26. Exercise apparatus according to claim 18, wherein the time period of said pulse forces generated is from about 5 to about 100 milliseconds.

27. Exercise apparatus according to claim 18, wherein the time period of each of said pulse forces generated is from about 30 to about 50 milliseconds.

28. Exercise apparatus according to claim 17, wherein the distance through which said body member is moved through each pulse is from about 2 millimeters to about 2 centimeters.

29. Exercise apparatus according to claim 17, wherein the distance through which said body member is moved through each pulse is about 1 centimeter.

30. Exercise apparatus according to claim 17, wherein the means for providing said primary resisting force is a weight and associated transmission means.

31. Exercise apparatus according to claim 17, wherein said body member engaging means includes means for rotating said body member about the axis of the joint thereof by each pulse force about $\frac{1}{2}$ to about 10 degrees.

32. Exercise apparatus according to claim 17, wherein said body member-engaging means includes means for rotating said body member about the axis of the joint thereof by each pulse force about 2 degrees.

33. Exercise apparatus according to claim 17, wherein said body member engaging means includes means for rotating said body member about the axis of the joint thereof by each pulse force about $\frac{1}{2}$ to about 5 degrees.

34. A method for exercising and stretching the muscles of a body member of an exercising subject, which comprises:

applying a primary resisting force in one direction to said body member and forcing said subject to overcome said resisting force as said subject moves said body member in the opposite direction, generating a series of pulse forces, the frequency of said series of pulse forces being greater than the frequency of the stroke of the body member against the primary resisting force, and superimposing said pulse forces on said primary resisting force in the same direction as that of said primary resisting force, the magnitude and duration of said pulse forces being sufficient to move said body member a short distance in the direction of said pulses and said primary resisting force with each pulse.

35. A method for exercising and stretching the muscles of a body member of an exercising subject, which body member is applying force in a certain direction, which comprises:

generating a series of pulse forces solely in one direction, and directly engaging said body member and applying said series of pulse forces directly to said body member in a direction opposite to the certain direction in which said body member is applying force while said body member is applying force in the certain direction, the magnitude, direction, and duration of said pulse forces being sufficient to cause said body member to be drawn back a distance with each pulse force in a direction opposite to said certain direction in which said body member is applying force, thereby causing the muscles of said body member to be stretched.

* * * * *

UNITED STATES PATENT AND TRADEMARK OFFICE

CERTIFICATE OF CORRECTION

PATENT NO. : 4,989,861

DATED : Feb. 5, 1991

INVENTOR(S) : Alan A. Halpern

It is certified that error appears in the above-identified patent and that said Letters Patent is hereby corrected as shown below:

Column 5, line 44; delete "said", second occurrence.

Column 7, line 3; delete "to", second occurrence.

Column 8, line 17: delete "has", second occurrence.

Column 14, line 37; "also used" should read -- also be used --.

Column 16, line 8; "said for" should read -- said means for --.

Signed and Sealed this

Eighteenth Day of August, 1992

*Attest:*

*Attesting Officer*

DOUGLAS B. COMER

*Acting Commissioner of Patents and Trademarks*